United States Patent [19]

Reinke

[11] 4,098,437

[45] Jul. 4, 1978

[54] FUEL NOZZLE SUPPORT AND CAP

[76] Inventor: Elmer E. Reinke, R.R. 1, Davenport, Nebr. 68335

[21] Appl. No.: 784,623

[22] Filed: Apr. 4, 1977

[51] Int. Cl.[2] ..... B67D 5/365

[52] U.S. Cl. ..... 222/529; 222/530; 248/75; 248/309 R

[58] Field of Search ..... 222/529, 530, 538; 248/75, 110, 111, 309 R, 339, 340, 342

[56] References Cited

U.S. PATENT DOCUMENTS

| | | | |
|---|---|---|---|
| 1,565,066 | 12/1925 | Dourson | 248/75 |
| 2,958,291 | 11/1960 | Rittenhouse | 222/530 X |
| 3,672,617 | 6/1972 | Neyendorf | 248/75 |

*Primary Examiner*—Robert B. Reeves
*Assistant Examiner*—Frederick R. Handren
*Attorney, Agent, or Firm*—Clarence A. O'Brien; Harvey B. Jacobson

[57] ABSTRACT

An elongated generally straight tubular member is provided and one end of the tubular member is flattened closed. The other end portion of the tubular member is open and is bevelled at an angle of between 20 and 70 degrees relative to a plane normal to the center line of the tubular member. The bevelled end portion is disposed in a plane normal to the plane of the flattened end portion and the extended lip defined by the bevelled end portion includes a slot formed therein opening laterally outwardly of one side of the lip at one end, the slot being closed at its other inner end. The slot may slidingly and retentively receive a hook portion carried by the base end portion of a fuel delivery nozzle telescoped into the open end of the tubular member and the open end of the slot is inclined toward the flattened end portion of the tubular member.

8 Claims, 4 Drawing Figures

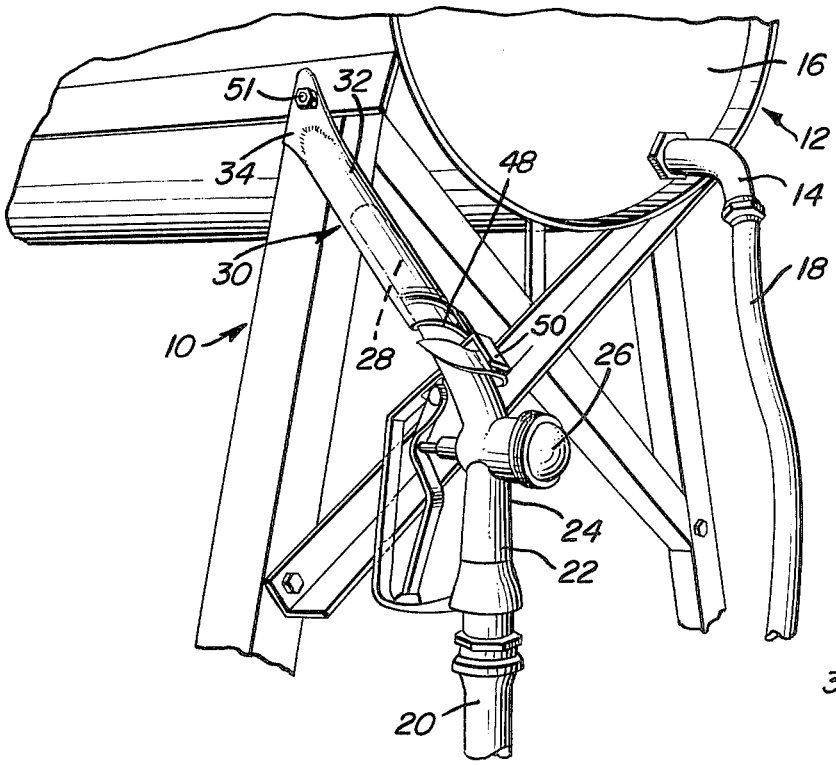
Fig. 1
Fig. 4
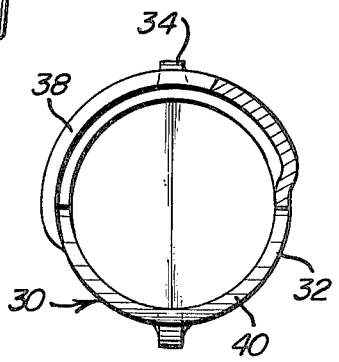
Fig. 2
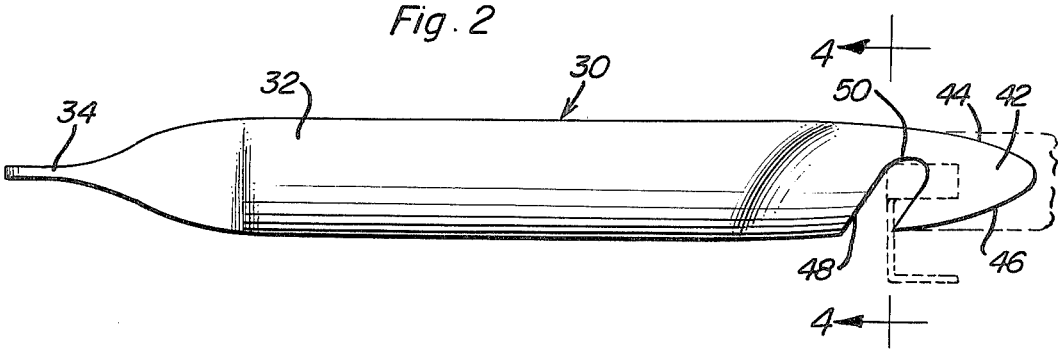
Fig. 3
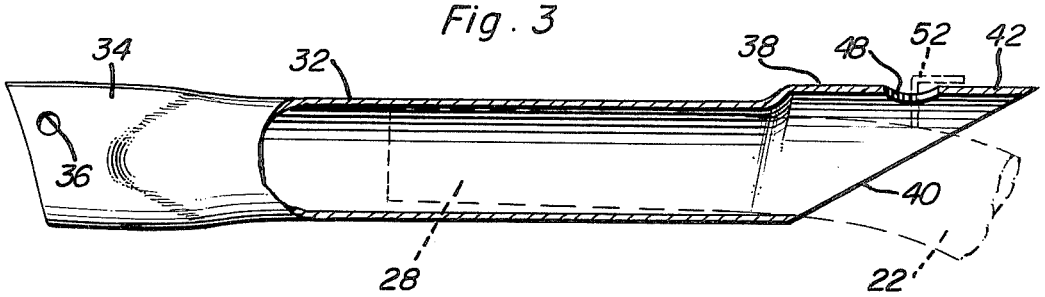

FUEL NOZZLE SUPPORT AND CAP

BACKGROUND OF THE INVENTION

Many rural farms and other rural businesses utilize their own fuel tanks for storage of fuel to power farm machinery and other equipment. In the interest of economy, these fuel storage tanks and the fuel delivery systems therefor are retained as simple as possible. One form of fuel storage tank utilizes a stand by which the tank is supported in an elevated position and a fuel delivery line extends from a lower portion of the tank and has a control nozzle at its discharge end. In this manner, fuel may be discharged from the tank by gravity and a fuel pump as well as controls therefor and a source of power to drive the pump are not required. However, the control valve or nozzle at the discharge end of the delivery hose of a simple gravity feed fuel supply tank is often stored in a manner which does not protect the nozzle against the entrance of rain water thereinto or against the nozzle being contaminated with dirt. As a result, farm equipment often has water and dirt introduced into the fuel tanks thereof from stationary elevated fuel supply tanks of the type above described.

Accordingly, a need exists for a fuel delivery hose control nozzle whereby the nozzle may be supported in a manner offering it considerable protection against the entrance of water into the nozzle and contamination of the interior or the exterior of the nozzle with dirt.

Examples of fuel delivery nozzle supports including some of the general structural and operational features of the instant invention are disclosed in U.S. Pat. Nos. 1,565,066, 2,900,111, 3,672,617 and 3,807,603.

BRIEF DESCRIPTION OF THE INVENTION

The fuel nozzle support of the instant invention comprises an upstanding tubular member whose upper end is flattened and provided with a transverse bore by which the tubular member may be supported from an elevated support in a position inclined downwardly from the support. The lower end of the tubular member is bevelled and open and the extended lip defined by the open bevelled lower end of the tubular member has a lateral slot formed therein for retentively receiving a hook portion provided on a conventional form of fuel delivery line nozzle.

The main object of this invention is to provide a support for a fuel delivery line nozzle.

Another object of this invention is to provide a support in accordance with the preceding object and including structure enabling the support to be readily mounted on a stand supporting an elevated fuel storage tank.

Yet another object of this invention is to provide a fuel nozzle support which may be utilized in conjunction with fuel line delivery nozzles of various types.

Another object of this invention is to provide a fuel nozzle support with which a conventional form of delivery line nozzle may be readily removably engaged.

Another very important object of this invention is to provide a fuel nozzle support which will enclose the delivery end of the nozzle in a manner preventing the nozzle from being contaminated with dirt and also preventing the entrance of rain water into the nozzle.

A final object of this invention to be specifically enumerated herein is to provide a fuel nozzle support in accordance with the preceding objects and which will conform to conventional forms of manufacture, be of simple construction and easy to use so as to provide a device that will be economically feasible, long lasting and relatively trouble free in operation.

These, together with other objects and advantages which will become subsequently apparent, reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is a fragmentary perspective view of a fuel storage tank support stand, a fuel storage tank supported from the stand and a fuel nozzle support constructed in accordance with the present invention supported from the stand and operatively supporting the control nozzle of the fuel delivery line from the tank therefrom;

FIG. 2 is an elevational view of the fuel nozzle support as seen from the upper side thereof;

FIG. 3 is a side elevational view of the fuel nozzle support with a major portion of the length of the support being broken away and illustrated in longitudinal section; and FIG. 4 is an enlarged transverse vertical sectional view taken substantially upon the plane indicated by the section line 4—4 of FIG. 2.

DETAILED DESCRIPTION OF THE INVENTION

Referring now more specifically to the drawings, the numeral 10 generally designates a conventional form of fuel drum support stand from whose upper portion a conventional form of fuel storage drum referred to in general by the reference numeral 12 is supported. The drum 12 includes a fuel delivery outlet fitting 14 secured through one end wall 16 of the drum 12 and the inlet end of a fuel delivery line 18 is operatively coupled to the outlet end of the fitting 14. The fuel delivery line 18 includes an outlet end 20 from which a conventional form of trigger-type fuel control nozzle 22 is supported. The nozzle 22 includes an inlet neck 24, a valve body 26 and an outlet neck 28.

The fuel nozzle support of the instant invention is referred to in general by the reference numeral 30 and comprises a tubular member 32 having one end transversely flattened as at 34 and provided with a transverse bore 36. The other end of the tubular member 32 is swaged as at 38 to increase the interior diameter thereof and bevelled as at 40. The bevelled end 40 is disposed in a plane normal to the medial plane of the flattened end 34 and the plane of the bevelled end 40 is inclined between 20 and 70 degrees relative to the longitudinal center line of the tubular member 32. In addition, the bevelled end 40 defines an outwardly extending lip 42 having opposite side endwise converging edges 44 and 46. The lip 42 has a lateral slot 48 formed therein closed at its inner end as at 50 and opening outwardly through the edge 46 at its other end. Further, it will be seen from FIG. 2 of the drawings that the slot 48 has its open end inclined toward the flattened end 34 and that the nozzle support is supported from the stand 10 by means of a shank-type fastener 51 secured through the bore 36 and anchored relative to the stand 10.

The nozzle 22 conventionally includes a hook 52 and the outlet neck or end 28 of the nozzle 22 is telescopingly receivable within the open end of the tubular member 32 in the manner illustrated in the FIG. 1 of the drawings. Further, the hook 52 is receivable within the slot 48 and the weight of the nozzle in addition to the adjacent discharge end 20 of the fuel delivery line 18 maintains the hook 52 seated in the closed end 50 of the slot 48 and thereby insures the nozzle 22 will remain supported from the fuel nozzle support 30 until such time as a person desiring to dispense fuel from the tank 12 grasps the nozzle 22 and rotates the latter in a counterclockwise direction as viewed in FIG. 1 of the drawings while simultaneously applying a slight upward thrust on the nozzle 22 whereby the hook 52 will be moved outwardly through the open outer end of the slot 48 freeing the nozzle 22 for disengagement from the fuel nozzle support. Of course, after the desired amount of fuel has been dispensed from the tank or drum 12, the nozzle 22 is replaced in the supported position thereof illustrated in FIG. 1 of the drawings with the outlet neck 28 of the nozzle 22 fully enclosed within the tubular member 32 and thus protected against the entrance of water into the outlet neck 28 and contamination of either the outer or inner surfaces of the outlet end 28 by dirt.

The tubular member is preferably constructed of metal and if there is any possibility that the nozzle 22 is not constructed of brass, it is preferable that the tubular member 32 be constructed of brass in order to eliminate the possibility of a spark as a result of contact of the nozzle 22 with the tubular member 32.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A fuel nozzle support including an elongated generally straight tubular member, one end portion of said tubular member being flattened to close the same, the other end portion of said tubular member being open and bevelled at an angle of between 20° and 70° relative to a plane normal to the center line of said other end portion and substantially on a plane normal to the plane of said flattened end portion, the extended lip defined by said bevelled end portion including a slot formed therein opening laterally outwardly of one side of said lip at one outer end and closed at its other inner end, said slot being adapted to slidingly and retentively receive a hook portion carried by the base end portion of a fuel delivery nozzle telescoped into said other end portion of said tubular member.

2. The combination of claim 1 wherein said tubular member is constructed of metal.

3. The combination of claim 1 wherein said other end portion of said tubular member is swaged to increase the internal diameter thereof.

4. The combination of claim 3 wherein the open end of said slot is inclined toward said one end portion of said tubular member.

5. The combination of claim 1 wherein the flattened end of said tubular member has an opening formed therethrough adapted to receive a shank-type fastener.

6. The combination of claim 5 wherein said other end portion of said tubular member is swaged to increase the internal diameter thereof.

7. The combination of claim 6 wherein the open end of said slot is inclined toward said one end portion of said tubular member.

8. In combination, a stand, a fuel storage container supported from an upper portion of said stand, said container including a gravity flow fuel outlet, a flexible delivery hose including an inlet end coupled to said outlet and an outlet end, a flow control nozzle carried by said outlet end and including a selectively operable manual control valve body outwardly from which a fuel delivery spout projects, an elongated generally straight tubular member, one end portion of said tubular member being flattened to close the same and including a transverse bore formed therethrough, a shank-type fastener secured through said bore and anchored relative to said upper portion of said stand with the other end portion of said tubular member inclined downwardly, the other end portion of said tubular member being open and bevelled at an angle of between 20° and 70° relative to a plane normal to the center line of said other end portion and substantially on a plane normal to the plane of said flattened end portion, the extended lip defined by said bevelled end portion including a slot formed therein opening laterally outwardly of one side of said lip at one outer end and closed at its other inner end, said slot slidingly and retentively receiving a hook therein carried by said valve body and said spout being loosely telescopingly received within said tubular member.

* * * * *